US006364412B1

(12) United States Patent
Crawford

(10) Patent No.: US 6,364,412 B1
(45) **Date of Patent: *Apr. 2, 2002**

(54) HANGING CHAIR

(76) Inventor: David H. Crawford, 5708 Table Top Ct., Boulder, CO (US) 80301

( * ) Notice: Subject to any disclaimer, the term of this patent is extended or adjusted under 35 U.S.C. 154(b) by 0 days.

This patent is subject to a terminal disclaimer.

(21) Appl. No.: 09/514,817

(22) Filed: Feb. 28, 2000

Related U.S. Application Data

(63) Continuation-in-part of application No. 09/217,530, filed on Dec. 21, 1998, now abandoned, which is a continuation-in-part of application No. 08/933,805, filed on Sep. 19, 1997, now Pat. No. 5,851,053.

(51) Int. Cl.[7] ..... A63G 9/12

(52) U.S. Cl. ..... 297/273; 297/232; 297/233; 297/248; 297/277; 297/297; 5/120; 5/123

(58) Field of Search ..... 297/273, 277, 297/278, 279, 280, 281, 232, 233, 248; 5/120, 122, 123, 124, 127, 128

(56) References Cited

U.S. PATENT DOCUMENTS

| | | | | | |
|---|---|---|---|---|---|
| 580,076 | A | | 4/1897 | Wohler | |
| 784,484 | A | * | 7/1905 | Bowie | 297/297 X |
| 925,044 | A | | 6/1909 | Shultz | |
| 1,192,941 | A | * | 8/1916 | Schmid | 297/297 X |
| 4,062,586 | A | * | 12/1977 | Ortize | 297/248 |
| 4,221,429 | A | | 9/1980 | Wade | 297/277 |
| 4,304,437 | A | | 12/1981 | Longo | 297/277 |
| 4,693,512 | A | | 9/1987 | Hobson | 297/277 |
| 4,825,855 | A | | 5/1989 | Kundson, Jr. | 128/79 |
| 4,838,609 | A | * | 6/1989 | Christensen | 297/297 |
| 5,588,702 | A | | 12/1996 | Litwin | 297/277 |
| 5,655,235 | A | * | 8/1997 | DeAth | 5/123 |
| 5,673,444 | A | * | 10/1997 | Middlendorf | 5/120 X |
| 5,944,381 | A | * | 8/1999 | Nguyen | 297/452.13 X |

FOREIGN PATENT DOCUMENTS

| | | |
|---|---|---|
| FR | 1026601 | 2/1953 |
| GB | 2 186 481 A | 8/1987 |

OTHER PUBLICATIONS

Above Ground Designs—The Aerial Chair Advertising Literature, pp. 1–3, date and place of publication are unknown.

Hangouts—Advertising Literature, Copyright 1986, 1992 and 1996, pp. 1–10, date and place of publication are unknown.

Hammocks by Linda—Advertising Literature, 2 pages, date and place of publication are unknown.

Hawaiian Sun Chairs—Advertising Literature and Setup Instructions, 5 pages, date and place of publication are unknown.

Laid Back Chairs—Advertising Literature, 2 pages, date and place of publication unknown.

Hanging Sky Chairs—Advertising Literature and Setup Instructions, 7 pages, date and place of publication are unknown.

* cited by examiner

*Primary Examiner*—Peter M. Cuomo
*Assistant Examiner*—Rodney B. White
(74) *Attorney, Agent, or Firm*—Holme Roberts & Owen LLP; Christopher J. Kulish, Esq.

(57) ABSTRACT

Disclosed is a hanging chair that is capable of accommodating more than one individual. Also provided is a hanging chair that includes a suspension structure that distributes the increased load that is associated with having more than one person in the chair over a length of the overhead support. By distributing the load, the possibility of the overhead support or the suspension structure failing is, inmost situations, reduced. The present invention further provides a hanging chair that is capable of rotating about a vertical axis without causing binding or twisting of the suspension structure.

36 Claims, 8 Drawing Sheets

HANGING CHAIR

CROSS-REFERENCE TO RELATED APPLICATIONS

The present application is a continuation-in-part of U.S. patent application Ser. No. 09/217,530, filed on Dec. 21, 1998, now abandoned which a continuation-in-part application of U.S. patent application Ser. No. 08/933,805, filed on Sep. 19, 1997, now U.S. Pat. No. 5,851,053.

FIELD OF THE INVENTION

The present invention relates to a hanging chair that is generally comprised of a chair member and a structure for suspending the chair from an overhead support.

BACKGROUND OF THE INVENTION

A hanging chair is comprised of a chair and a suspension structure that connects the chair to an overhead support. In one type of hanging chair, the chair is comprised of a flexible panel that is defined by an upper edge, left edge, right edge and lower edge. The distance between the upper and lower edges is generally adequate for supporting the head, torso and at least a portion of the lower extremities of the typical user. Similarly, the distance between the left and right edge is generally sufficient to support the width of the typical user. The suspension structure includes a laterally extending support member, i.e., a member that extends left to right across the body of a user when the user is in the chair, that is connected to the left and right sides of the flexible panel. Also part of the suspension structure is a rope for connecting the laterally extending support member to the overhead support. The ends of the rope are attached to the ends of the laterally extending support member. A loop at the midpoint of the rope is used to suspend the chair from a hook or similar structure that is anchored into the overhead support. In this particular embodiment, the laterally extending support member is generally of a length that is greater than the lateral or left-right dimension of the typical user. As a consequence, the laterally extending support member prevents the left and right sides of the flexible panel from folding in on the user when the user reclines in the chair.

In another embodiment that employs a flexible panel, the suspension system has been modified so that it also prevents the upper and lower edges of the panel from folding in on the user when the user reclines in the chair. This is accomplished by using two side support members that extend along the sides of the chair. One end of each of the side support members is connected to the upper end of a side and the other end is connected to the lower end of the side, thereby preventing the upper and lower edges of the panel from folding in on the user. The ends of the two side support members are connected to the ends of the laterally extending support member, which is connected to the overhead support as previously described.

A further type of hanging chair employs a chair that is comprised of a rigid peripheral structure, which is generally made of wood or some kind of tubing, and a web that spans the rigid peripheral structure. Typically, ropes or cables are used to attach the rigid peripheral structure to the overhead support.

Yet another type of hanging chair uses a chair in which at least one of the back and seat portions is made of wood, plastic or other relatively rigid material. The lateral sides of the chair member are typically attached to the overhead support member using ropes or chains. An example of this type of chair is the well known porch swing.

SUMMARY OF THE INVENTION

The present invention is directed to a hanging chair that provides the user with the ability to readily adjust the angle of the chair relative to the ground. One embodiment of the invention includes a chair with a back portion for supporting the user's torso and a seat portion for supporting at least a portion of the lower extremities of the user. The chair is also generally symmetrical about a longitudinal axis that divides the back and seat portions into a left lateral side and a right lateral side. When in use, the user's body generally reclines in a direction that is parallel to the longitudinal axis of the chair. A suspension structure is provided that serves both to hang the chair from an overhead support and to provide the user with the ability to readily adjust the angle of the chair relative to the ground. The suspension structure includes a longitudinally extending rod or pole, a first linkage for connecting the chair to the rod, and a second linkage for connecting the rod to the overhead structure. In adjusting the angle of the chair relative to the ground, the first linkage serves to maintain the position of the chair relative to the rod. As a consequence, the angle of the rod relative to the ground substantially determines the angle of the chair relative to the ground. The second linkage provides the ability to easily and quickly adjust the angle of the rod and the angle of the chair relative to the ground. In one embodiment, the second linkage includes a rope whose ends are attached to the ends of the rod and a slip knot that engages a hook or similar structure associated with the overhead support. By adjusting the location of the slip knot, the angle of the rod and chair relative to the ground can be readily adjusted. In another embodiment, the second linkage again uses a rope whose ends are attached to the ends of the rod. However, in this embodiment, a fixed knot is employed and the length of the rope extending between the ends of the rod is adjusted to change the angle of the chair. The length of rope is adjusted by changing the point on the rope at which the rope is attached to one end of the rod. In a third embodiment, the angle of the rod is altered by employing a second linkage that contacts the rod at a single location which can be adjusted. For example, if the second linkage joins the rod at a point that is closer to the back portion of the chair than the seat portion of the chair, the chair will be oriented in a relatively upright position. If the point at which the second linkage joins the rod is then moved more towards the seat portion of the chair, the chair is oriented in a more reclined position.

The present invention also provides for adjustment of the angle of the chair relative to the ground by permitting the distance between the seat portion and the ground to be adjusted. In this adjustment, the length of the linkage between the top of the back portion of the chair and the ground cannot be adjusted. However, the length of the linkage between points lower down on the back portion of the chair or on the seat portion of the chair and the ground can be adjusted. Adjustment of the length of this linkage, in effect, causes the chair to rotate about the top of the back portion of the chair, thereby changing the angle of the chair relative to the ground. Alternatively, a linkage associated with the seat portion of the chair could be of fixed length and the length of the linkage associated with points further up the chair could be adjustable to alter the angle of the chair relative to the ground.

Also provided by the present invention is a combination hanging chair and footrest that employs a less complex suspension structure than known hanging chairs. The chair portion of the invention is comprised of a flexible material.

A suspension structure serves to hang the chair from an overhead support and to deploy the flexible material of the chair such that the chair does not collapse in upon the user. The suspension structure includes three rods and a linkage that connects the rods to the chair. The rods serve both to prevent (1) the left and right sides of the chair from collapsing in on the user and (2) the seat and back portions of the chair from collapsing in on the user. In other words, the rods serve to hold the flexible material of the chair open. At least one of the rods extends laterally, i.e. across the user's body when the user is in the chair. This rod is also employed to support the footrest. Know hanging chairs require at least four rods to accommodate a combination hanging chair and footrest.

The present invention also provides a hanging chair that is made of a flexible material and dimensioned to seat more than one person and a suspension structure that connects the chair member to an overhead support structure. Further, to prevent the individuals residing in the chair from being pushed towards one another, the chair includes a dividing member. In one embodiment, the dividing member includes a pair of straps that are located on a line that bisects the chair and that are attached to the suspension structure created an inverted V-shape in the flexible material to, in effect, separate a first chair from a second chair.

In another embodiment, the suspension structure is adapted to distribute the load that two or more individuals can create over a length of the overhead support. This serves, at least where the overhead support is supported at both of its ends, to reduce the possibility that the either the overhead support or suspension structure will fail under load. The load distribution aspect of the suspension structure is also applicable to hanging chairs that are dimensioned to seat a single individual. In one embodiment, the suspension structure is adapted to connect to at least two locations on the overhead beam. By establishing connections at two, spaced apart locations, the load of the chair and any occupants is divided such that a portion of the load is borne at one location and the remainder of the load is borne at the other location.

One embodiment of a hanging chair that can accommodate more than one individual employs a suspension structure that includes a longitudinal support member that, when the chair is suspended from an overhead support, lies substantially in a plane that bisects the chair member and is perpendicular to the ground. Also part of the suspension structure is a lateral support member that extends substantially perpendicular to the longitudinal support structure. The longitudinal and lateral support members serves, among other things, to hold a chair member that is made from flexible material open. In the case of a chair that accommodates more than one person, the lateral support member is longer than the longitudinal support member. For a two person chair, the lateral support member has a length greater than about four feet.

A further embodiment of the hanging chair includes a swivel that is located between the hanging chair and the overhead support. The swivel permits the chair to rotate about a vertical axis while prevent twisting or the binding of the remainder of the suspension structure. This prevents the chair from being rotated in, for example, a clockwise direction a number of times to establish a twist in the suspension structure and then later rotating in a counterclockwise direction. Moreover, if a eye bolt is used to connect the chair member to the overhead support, the swivel prevents torque that could otherwise loosen the bolt.

A further embodiment of the hanging chair includes a chair member with a longitudinal line that bisects the chair member. When the chair member is suspended from an overhead support, the longitudinal line defines a plane that is substantially perpendicular to the ground. A suspension structure connects the chair member to the overhead support. The suspension structure includes a support member that has at least two points which lie in the plane defined by the longitudinal line; a first portion for connecting the chair member to the support member; and a second portion that connects the support member to the overhead support and lies substantially in the plane defined by the longitudinal line. Suitable support members include a rod that lies substantially entirely within the plane. Another suitable support member includes a hoop with two, diametrically opposite points located within the plane. Support members with many different shapes are possible, provided that the support member has at least two points that lie in the plane. In one embodiment, the second portion of the suspension structure also provides the ability to adjust the angle of the support member and, as a consequence, the angle of the chair member relative to the ground.

DETAILED DESCRIPTION

Figure 1:
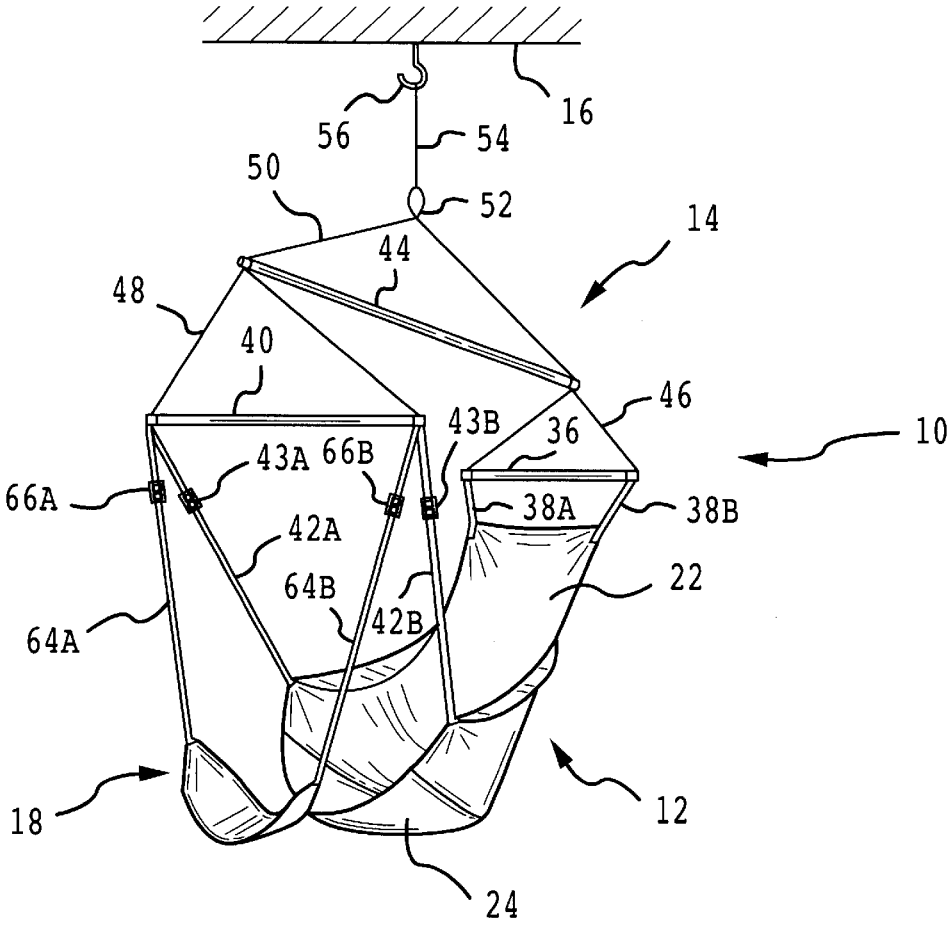
FIG. 1 is a perspective view of the hanging chair of the present invention.

FIG. 1 illustrates an embodiment of a hanging chair 10 of the present invention. Generally, the hanging chair 10 includes a chair 12, a suspension structure 14 for suspending the chair 12 from an overhead support 16, and a footrest 18.

Figure 2:
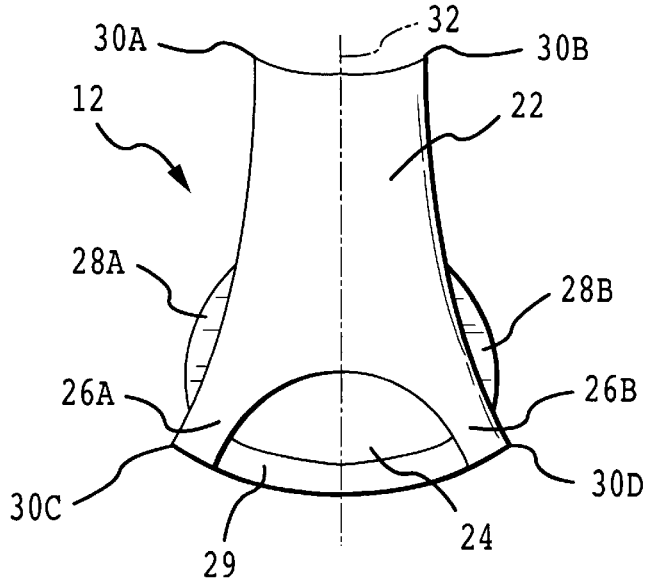
FIG. 2 is a plan view of the chair portion of the hanging chair illustrated in FIG. 1.

With reference to FIG. 2, the chair 12 is comprised of a back portion 22 for supporting the user's back, a seat portion 24 for supporting the lower extremities of the user, and right and left side portions 26A, 26B that cooperate with the back portion 22 and seat portion 24 to form a "bucket" type seat. The chair 12 also includes right and left padded armrests 28A, 28B. A padded seat edge 29 is also provided for the user's comfort. The chair is further defined by four suspension points 30A, 30B, 30C and 30D that are the points of contact between the chair 12 and the suspension structure 14. The four suspension points 30A, 30B, 30C and 30D also roughly define a quadrilateral shape and more specifically a trapezoidal shape. To elaborate, a line drawn between the first and second suspension points 30A, 30B is substantially parallel to, but shorter than a line drawn between the third and fourth suspension points 30C, 30D. Further, a line drawn between the first and third suspension points 30A, 30C is substantially the same length as, but not parallel to a line drawn between the second and fourth suspension points 30B, 30D. It should also be appreciated that the chair 12 is substantially symmetrical about a longitudinal axis 32. In the illustrated embodiment the chair is made of a flexible material, such as canvas, upholstery fabric, tapestry fabric, woven mesh, leather, pack cloth and the like.

The suspension structure 14 includes aback lateral bar 36 that is connected to the first and second suspension points 30A, 30B by back suspension straps 38A, 38B that include webbing cups, which are used throughout the suspension structure 14. Similarly, a seat lateral bar 40 is connected to the third and fourth suspension points 30C, 30D by seat suspension straps 42A, 42B whose lengths can be adjusted by seat buckles 43A, 43B, respectively. Also forming part of the suspension structure 14 is a longitudinal bar 44 that is oriented substantially parallel to and preferable in the same plane as the longitudinal axis 32 of the chair 12. The longitudinal bar 36 is connected to the back lateral bar 36 by a back rope 46 and connected to the seat lateral bar 40 by a seat rope 48. The back lateral bar 36, seat lateral bar 40 and longitudinal bar 44 cooperate to hold the chair, which is made of a flexible material, open so that it does not fold in on the user when the user reclines in the chair 12. To elaborate, the back lateral bar 36 and seat lateral bar 40 prevent the right and left sides of the chair 12 from folding in on the user. Similarly, the longitudinal bar 44 prevents the back portion 22 and seat portion 24 of the chair 12 from collapsing in on a user. The lengths of the back lateral bar 36, seat lateral bar 40 and longitudinal bar 44 are respectively 2, 3 and 4 feet. The bars are made of a hardwood, such as ash. However, other materials can also be used, such as plastic or metal piping.

Also part of the suspension structure 14 is a top rope 50 with ends that are operatively attached to the ends of the longitudinal bar 44. Located intermediate to the ends of the top rope 50 is a slip knot that facilitates altering the angle of the longitudinal bar 44 and the chair 12 relative to the ground. A height adjustment rope 54 and hook 56 complete the suspension structure 12. The height adjustment rope 54 allows the distance between the chair 12 and the ground to be adjusted to suit the user. In some cases, the height adjustment rope 54 may be unnecessary.

Figure 3A:
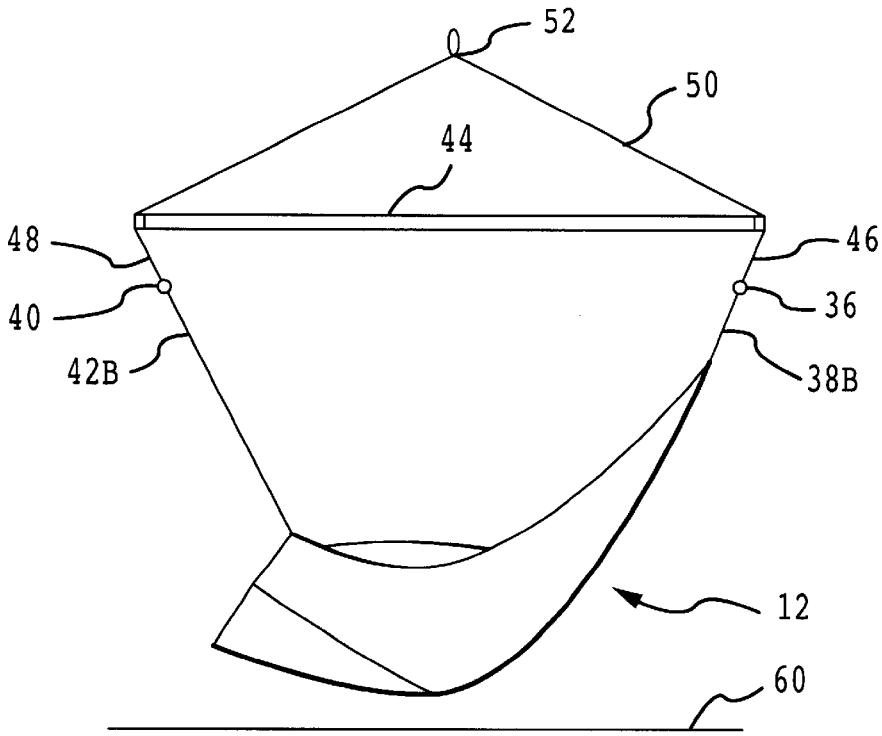
FIGS. 3A and 3B are sides view of the hanging chair that illustrate the use of the longitudinally extending rod in adjusting the angle of the chair relative to the ground.
Figure 3B:
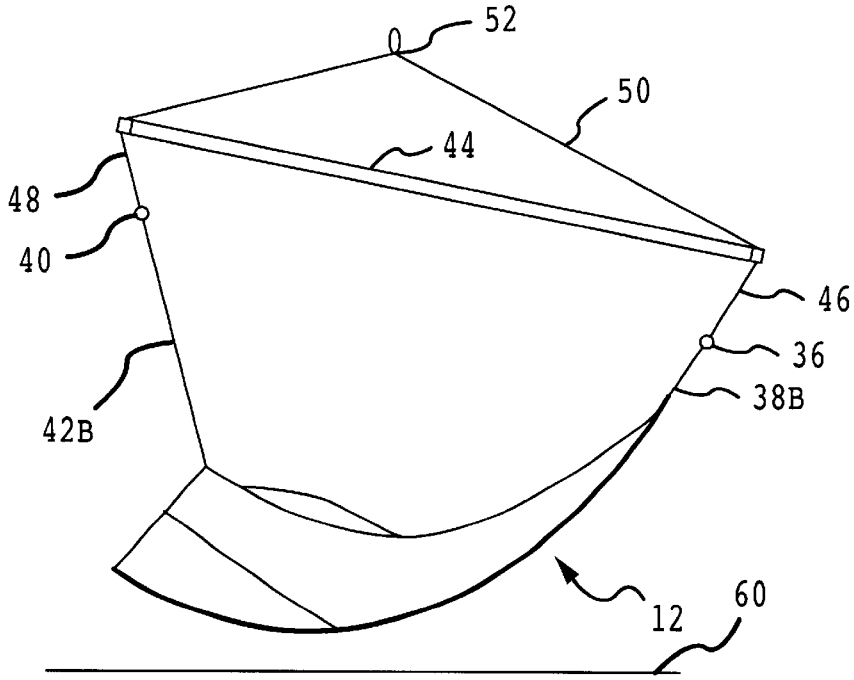

With reference to FIGS. 3A and 3B, adjustment of the reclination angle or angle of the chair relative to the ground is discussed. FIG. 3A illustrates the chair 12 at a first angle relative to the ground and the longitudinal bar 44 substantially parallel to the ground. The angular orientation of the chair 12 and longitudinal bar 44 is determined by the location of the slip knot 52. In this particular case, the slip knot 52 is located substantially midway between the ends of the top rope 50. The components of the suspension structure located between the longitudinal bar 44 and the chair 12 have little effect on the angle of the longitudinal bar 44 and the chair 12 relative to the ground. As a consequence, these components substantially maintain the positional relationship of the chair 12 relative to the longitudinal bar 44.

FIG. 3B illustrates the chair 12 in a more reclined position relative to the chair 12 in FIG. 3A. Also apparent from comparison of FIGS. 3A and 3B is that the longitudinal bar 44 in FIG. 3B is no longer substantially parallel to the ground. The change in the angles of the chair 12 and the longitudinal bar 44 relative to the ground is attributable to a change in the location of the slip knot 52, which is now located more towards the seat portion 24 of the chair 12 than the slip knot 52 of FIG. 3A. From the foregoing, it can be appreciated that the angle of the chair 12 relative to the ground can be easily and quickly adjusted by adjusting the location of the slip knot 52 in the top rope 50. In contrast, the suspension structures of other known hanging chairs requires that two ropes or linkages, one associated with each side of the chair, be adjusted to change the angle of the chair relative to the ground. If the two linkages are not adjusted equally these chairs become skewed. Consequently, time must be taken to adjust two separate structures and to assure that both structures are adjusted equally.

Figure 4A:
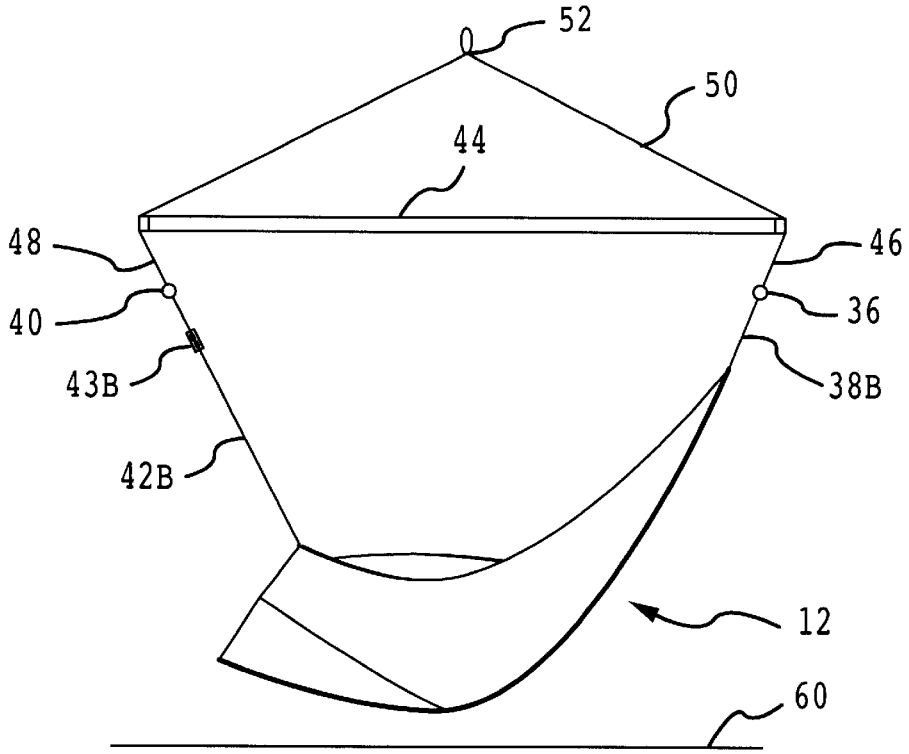
FIGS. 4A and 4B are side views of the hanging chair that illustrate the use of an adjustable linkage to alter the angle of the chair relative to the ground.
Figure 4B:
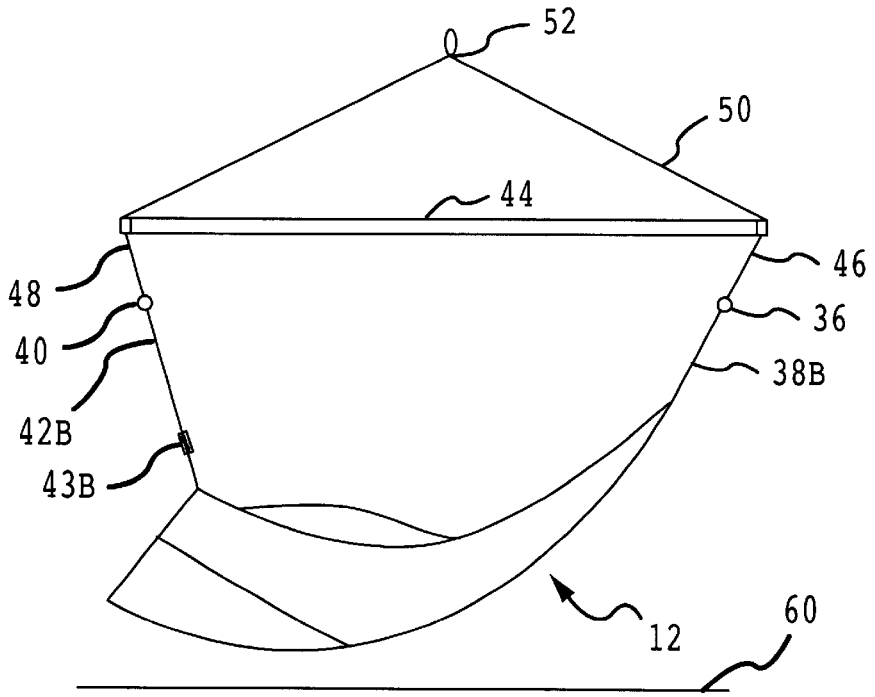

With reference to FIGS. 4A and 4B, a different manner of adjusting the reclination angle of the chair 12 is discussed. This manner of adjusting the angle of reclination involves changing the distance between the seat portion 24 of the chair 12 and the ground 60. In the illustrated embodiment, this adjustment is achieved by changing the lengths of the seat suspension straps 42A, 42B using buckles 43A, 43B. In FIG. 4A, the seat suspension straps 42A, 42B are relatively long. As a consequence, the seat portion 24 of the chair 12 is relatively close to the ground and the chair 12 is in a relatively upright position. FIG. 4B, in contrast, illustrates the use of the buckles 43A, 43B to shorten the length of the seat suspension straps 42A, 42B and thereby place the chair 12 in a more reclined position with the chair 12 positioned further from the ground 60 relative to the chair in FIG. 4A. To facilitate making the seat suspension straps 42A, 42B of equal length, the straps are made from a webbing material that has a colored thread which is exposed at a predetermined interval, such as once every inch.

The padded footrest 18 is connected to the seat lateral bar 40 by footrest suspension straps 64A, 64B. The position of the footrest 18 is adjusted by changing the length of the footrest suspension straps 64A, 64B using footrest buckles 66A, 66B. To assure that both of the footrest suspension straps 64A, 64B are of equal length, the straps are marked at a predetermined interval, as with the seat suspension straps 42A, 42B.

Figure 5A:
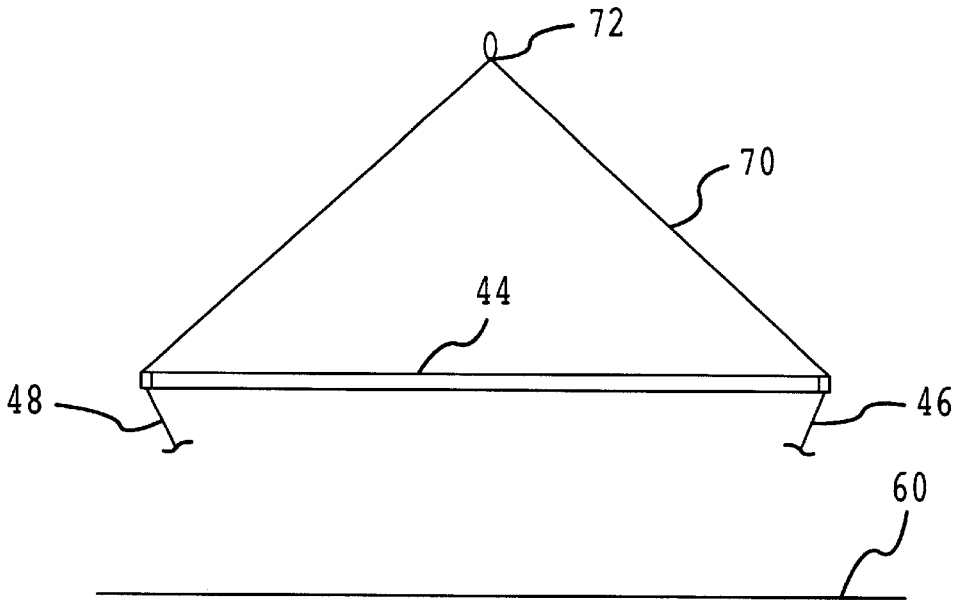
FIGS. 5A and 5B illustrate an alternative structure for adjusting the angle of the chair relative to the ground.
Figure 5B:
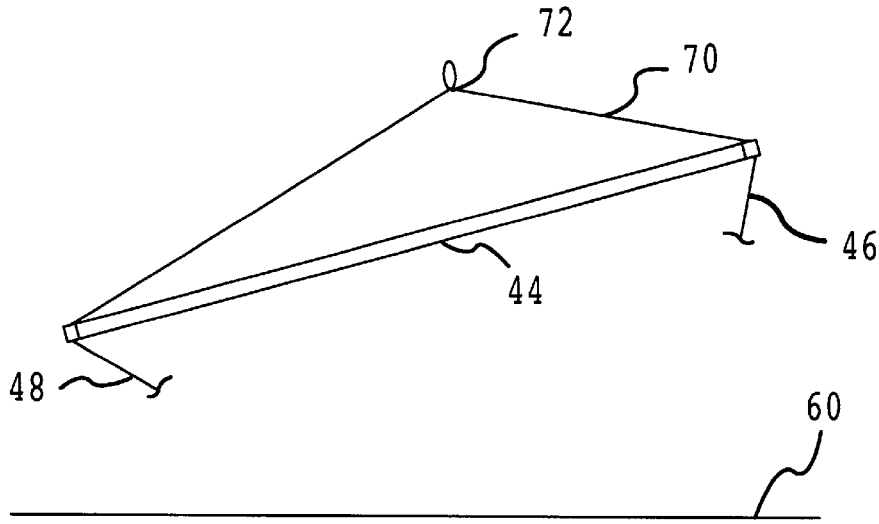

With reference to FIGS. 5A and 5B, a different linkage for adjusting the angle of the longitudinal rod 44 and the chair 12 is discussed. In this case, a length adjustable top rope 70 is provided with a fixed knot 72 located between the ends of the rope. As shown in FIG. 5A, the fixed knot 72 is located substantially midway between the points of the rope that are connected to the ends of the longitudinal bar 44. As a consequence, the longitudinal bar 44 is oriented substantially parallel to the ground 50. The chair 12 has an orientation relative to the ground that is dependent upon the linkage between the longitudinal rod 44 and the chair 12. By changing the point at which one end of the rope 70 is attached to the end of the longitudinal rod, the length of the rope 72 between the ends of the longitudinal rod 44 is changed. Changing the length of the rope 70 causes the fixed knot 72 to be moved more towards the back portion 22 of the chair 12. Moving the fixed knot 72, in turn, changes the angle of the longitudinal bar 44 and the chair 12 relative to the ground 60. It is also possible to change the point at which the other end of the rope 70 attaches to the other end of the longitudinal rod 44 to affect the angle of the longitudinal rod 44 and chair 12 relative to the ground 60.

Figure 6A:
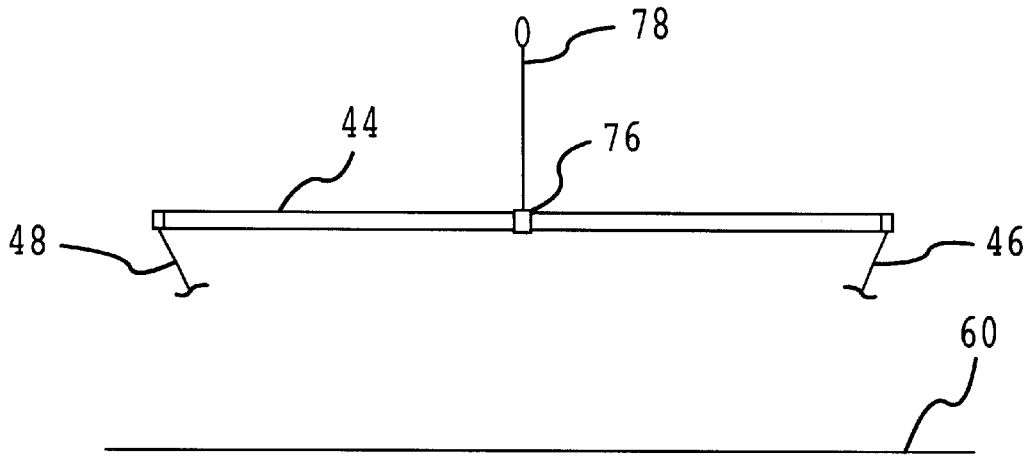
FIGS. 6A and 6B illustrate another alternative structure for adjusting the angle of the chair relative to the ground.
Figure 6B:
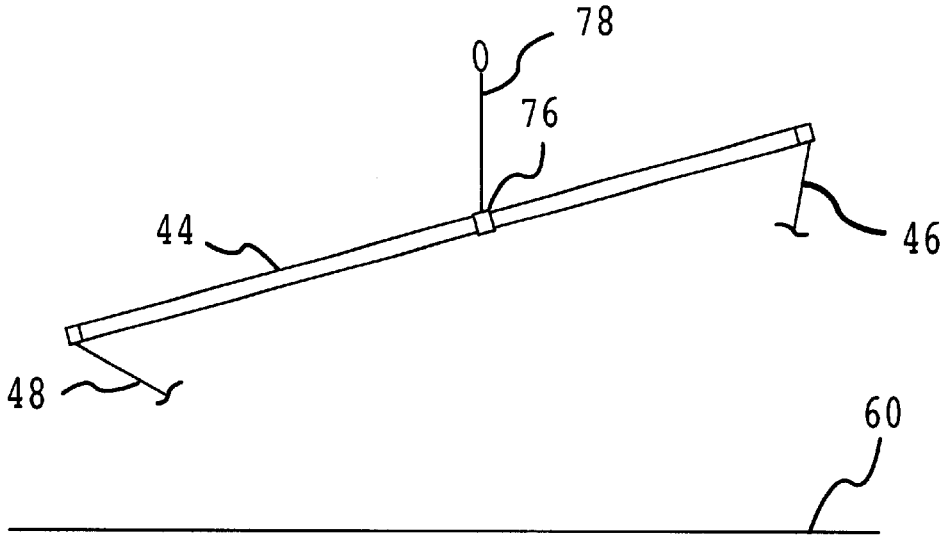

With reference to FIGS. 6A and 6B, a further structure for changing the angle of the longitudinal bar 44 and chair 12 is discussed. This particular linkage includes a fixture 76 that can be fixed in place at any point along the length of the longitudinal bar 44. A linkage 78 that can swivel or rotate with respect to the fixture 76 provides at least part of the connection between the fixture 76 and the overhead support 16. In FIG. 6, the fixture 76 is located substantially midway between the ends of the longitudinal bar 44 and the longitudinal bar 44 is positioned substantially parallel to the ground 60. This, in turn, places the chair 12 in a particular orientation. As shown in FIG. 6B, the position of the fixture 76 has been changed relative to the position shown in FIG. 6A. As a consequence, the angle of the longitudinal bar 44 relative to the ground 60 has been changed. This, in turn, has changed the angle of the chair 12 relative to the ground as previously discussed.

Figure 7:
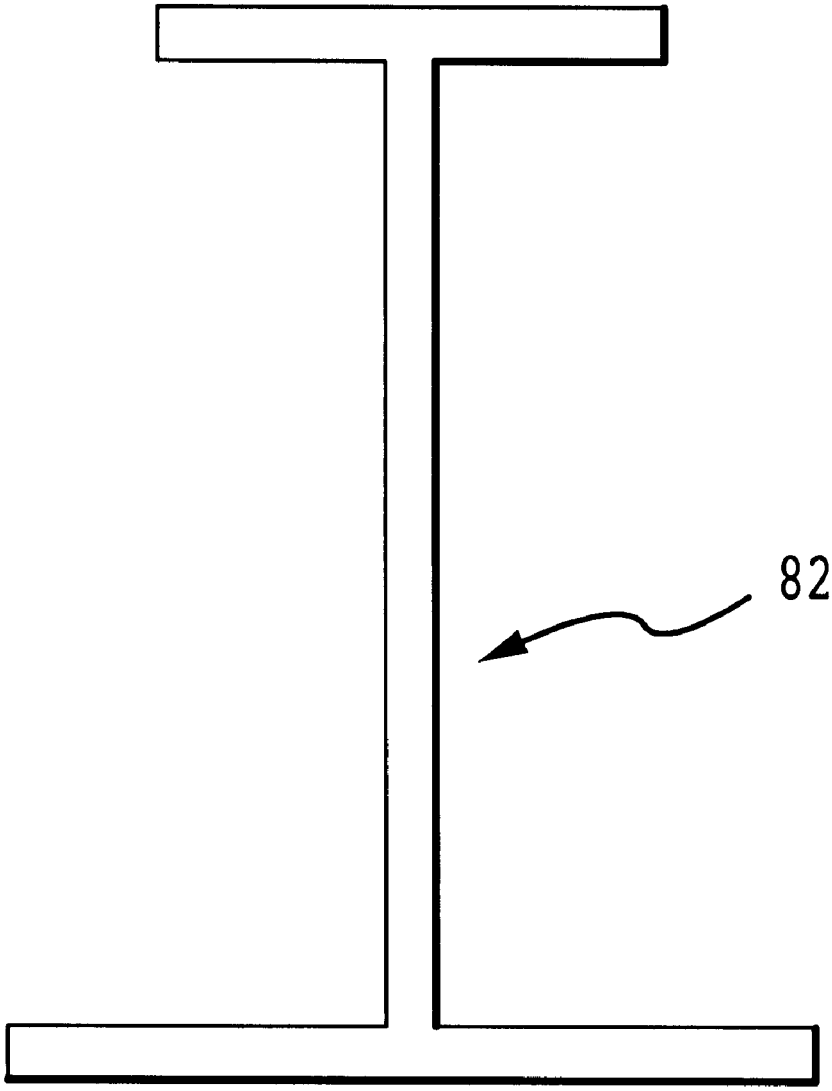
FIG. 7 illustrates an alternative suspension structure that utilizes an I-shaped frame.

With reference to FIG. 7, a single piece bar 82 for use in the suspension structure 14 is illustrated. The unitized bar 82 combines the back lateral bar 36, seat lateral bar 40 and longitudinal bar 44 associated with the suspension structure discussed with respect to FIG. 1 into a monolithic unit that avoids the need for the back rope 46 and seat rope 48. The unitized bar 82 can be constructed in from conventional piping materials or by other methods known in the art.

The adjustment of the angle of the chair 12 via adjustment to the angle of the longitudinal bar 44 is applicable to other types of chairs from that disclosed with respect to FIG. 1. For instance, the adjustment of the angle of the chair disclosed hereinabove can be applied to chairs that have a rigid peripheral framework that is spanned by a flexible web. The structure for adjusting the reclining angle of a chair can also be applied to chairs that use a panel of relatively rigid material, such as wood, to realize the back and/or seat portion of the chair. If a chair structure is utilized in which at least a portion of the periphery or outer edges of the back or seat portions is rigid, as with either of the two noted types of chairs, the suspension structure is susceptible to modifications that eliminate either or both of the lateral bars but retain the longitudinal bar 44 and associated structure for adjusting the angle of the longitudinal bar 44. For example, if a chair is utilized in which the back and seat portions are made from panels of wood and connected to one another so that their positions with respect to one another are fixed, the lateral bars are no longer needed to hold the chair in an open position. As a consequence, linkages between the chair and the longitudinal bar 44 that do not incorporate the lateral bars are feasible. The structure for adjusting the reclining angle of a chair can also be applied to chairs of different shapes. For instance, the structure can be applied to oval, round, and rectangular chair shapes, as well as many other chair shapes.

Figure 8:
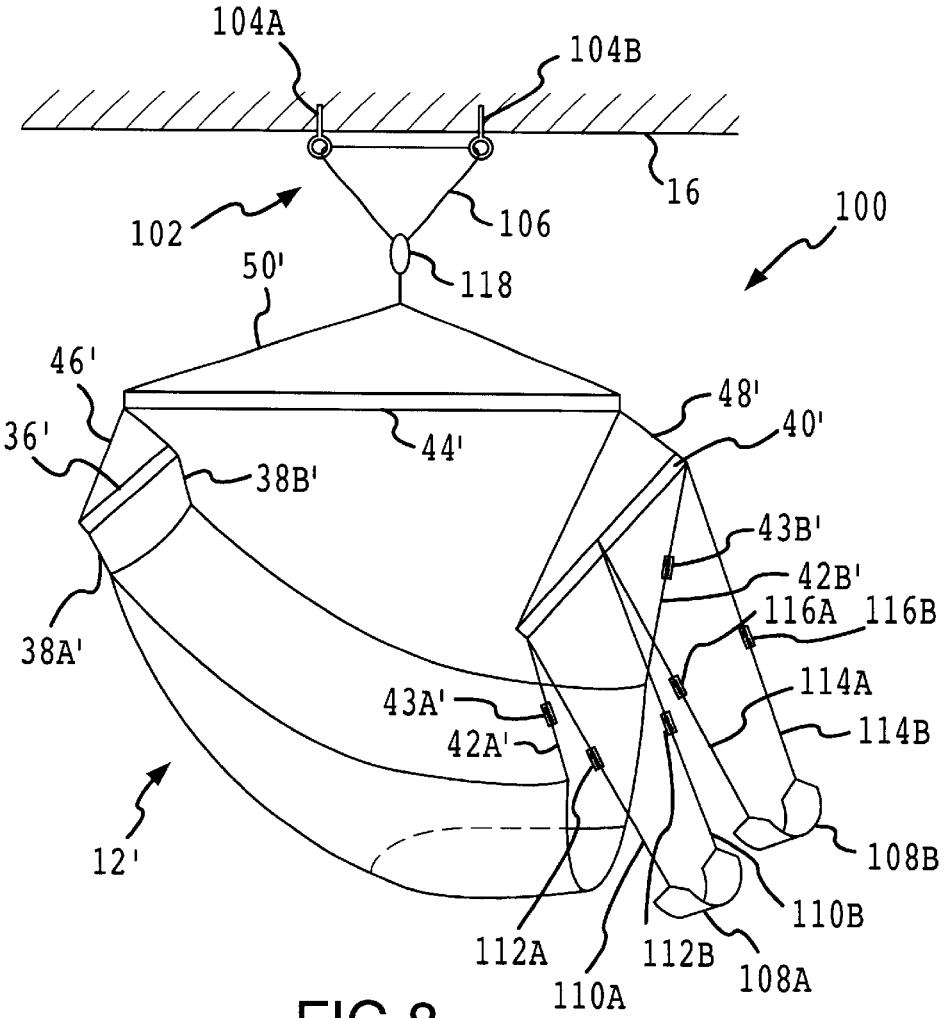
FIG. 8 illustrates a hanging chair that is capable of accommodating two, adult individuals.

With reference to FIG. 8, an embodiment of a hanging chair 100 that is capable of accommodating two individuals is illustrated. Elements of the hanging chair 100 that are common to the hanging chair 10 are given the same reference numbers as the comparable elements of the hanging chair 10. However, to differentiate the elements of the hanging chair 100 that are common to the chair 10, the reference numbers associated with the hanging chair 100 are given primed reference numbers. The chair 12' has substantially the same length as the hanging chair 12. As a consequence, the longitudinal bar 44' of the hanging chair 100 is substantially the same length as the longitudinal bar 44, i.e, approximately four feet in length. However, the chair 12' is of a greater width that is capable of accommodating two adults. Due to this greater width, the back lateral bar 36' and seat lateral bar 40' are also of greater lengths. The back lateral bar 36' is approximately 3 ½ feet in length. The seat lateral bar 40' is approximately five feet in length. To address the greater load, the diameters of the back lateral bar 36', seat lateral bar 40' and longitudinal bar 44' are appropriately increased. If a hanging chair capable of accommodating a greater number of individuals is required, the dimensions of the chair 12', back lateral bar 36' and seat lateral bar 40' are scaled accordingly.

To address the greater load associated with more than one individual in the hanging chair 100, the suspension structure for connecting the chair 12' to the overhead support 16 includes a load distribution device 102. The load distribution device include two, eye bolts 104A, 104B that engage the overhead support 16. Also included in the load distribution device is a loop 106 that, in operation, extends through the eye bolts 104A, 104B. The loop 106 is, in turn, attached to the top rope 50'. This attachment scheme distributes the load of the chair 12' and any occupants over a length of the overhead support 16 rather than concentrating the load at a single point on the overhead support 16. Attachment devices other than the eye bolts 104A, 104B are also feasible. For instance, bolts that extend laterally through the overhead support can be used. Further, an alternative to the loop 106 is a length of rope with one end attached to the eye bolt 104A , the other end attached to the eye bolt 104B, and an intermediate point attached to the top rope 50'. In situations where the overhead support 16 is exposed in two places such that a rope can be tied around the support 16, holes can be drilled through the overhead support 16 in two places, or the overhead support 16 is exposed in one location and a hole can be drilled in another location, the use of bolts can be avoided. In this case, one end of rope is attached to one locations, the other end of the rope is attached to the other location, and a point on the rope that is located intermediate to the two ends of the rope is attached to the top rope 50'. It should be appreciated that the a structure for distributing the load can also be used with chair 10 if needed.

Adjustment of the angle of the chair 12' can be accomplished as shown in FIGS. 3A and 3B or as shown in FIGS. 5A and 5B. With appropriate modifications, adjustment of the angle of the chair 12' can also be accomplished as shown in FIGS. 6A and 6B. In addition, adjustment of the angle of the chair 12' can be accomplished using the buckles 43A', 43B'.

The chair 100 also includes two, padded foot rests 108A, 108B, one for each the potential occupants of the chair 12'. The foot rest 108A includes foot rest suspension straps 110A, 110B that extend from the seat lateral bar 40' and buckles 112A, 1121B that permit adjustment of the lengths of the strap 110A, 111B. Likewise, foot rest 108B includes foot rest suspension straps 114A, 114B and adjustment buckles 116A, 1163B.

To provide the ability to rotate the chair about a vertical axis, the chair 100 includes a swivel 118 that is disposed between the chair 12' and the overhead support 16. The swivel 118 also prevents twisting of the suspension structure that would create a torque that might loosen any bolts or other threaded elements that are used to engage the overhead support 16.

Figure 9:
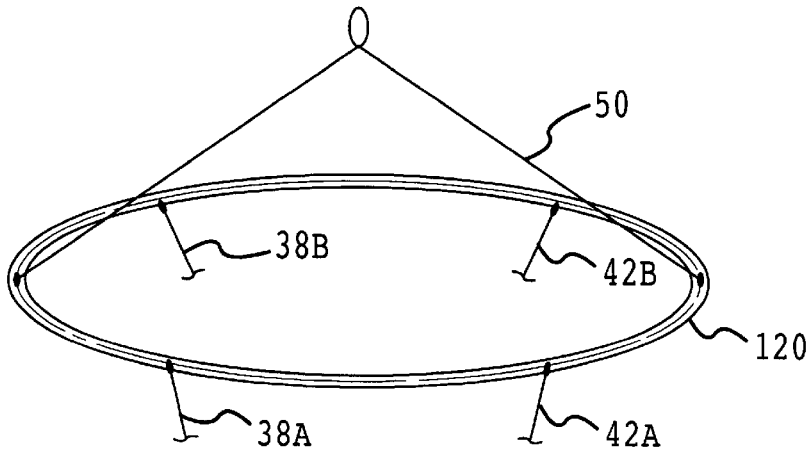
FIG. 9 illustrates a hoop shaped, support member.

With reference to FIG. 9, a unitary bar structure 120 that has at least two points that lie in the plane defined by the bisecting line of the chair 12 is illustrated. The unitary bar structure 120 is in the shape of a hoop that has two, diametrically opposite points that lie in the noted plane. As noted with respect to the single piece bar 82 of FIG. 7, the use of a unitary bar structure avoids the need for the back rope 46 and seat rope 48. It should be noted that there are many unitary bar structure shapes that satisfy the criteria of having at least two points located in the noted plane. Characteristic of many, but not necessarily all of these structures is that they are symmetrical about the plane. When using the unitary bar structure 120, adjustment of the angle of the chair 12 or the chair 12' is accomplished as shown in FIGS. 3A and 3B or as shown in FIGS. 5A and 5B. In addition, adjustment of the angle of the chair 12 or chair 12' can be accomplished using the buckles 43A, 43B.

Figure 10:
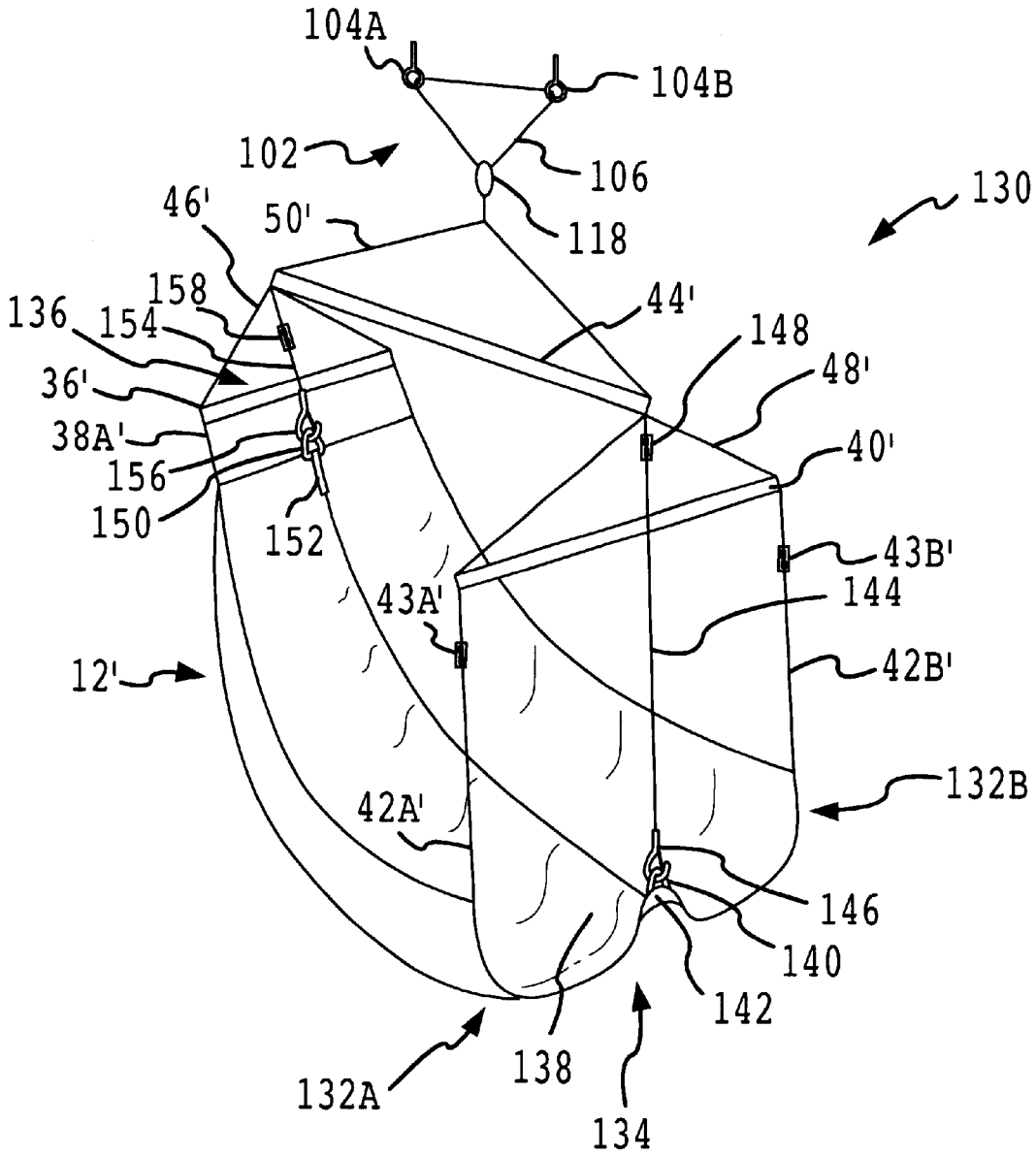
FIG. 10 illustrates a hanging chair that is capable of accommodating two, adult individuals while also providing a structure for separating the two individuals from one another.

With reference to FIG. 10, an embodiment of a hanging chair 130 that is capable of accommodating two individuals is illustrated. For ease of illustration, the footrests have been omitted. Elements of the hanging chair 130 that are common to the hanging chair 100 are given the same reference numbers as the comparable elements of the hanging chair 100. The hanging chair 130 includes a dividing structure that divides the chair 12' into a first chair 132A and a second chair 132B. The dividing structure includes a first strap system 134 and a second strap system 136 that cooperate to create a ridge 138 with an inverted V-shape cross section that runs along the longitudinal axis of the chair 12' to divide the first chair 132A from the second chair 132B. The first strap system 134 includes a first D-ring 140 that is attached to the edge of the chair 12' by a piece of reinforcing fabric 142. Also part of the first strap system 134 is a first strap 144 with one end that includes a first snap hook 146 for engaging the first D-ring 140. The other end of the first strap 144 is attached to an end of the longitudinal bar 44'. Located between the ends of the first strap 144 is a first buckle 148 that permits the length of the first strap 144 to be adjusted. The second strap system includes a second D-ring 150 that is attached to the edge of the chair 12' by a piece of webbing 152. Also part of the second strap system 136 is a second strap 154 with one end that includes a second snap hook 156 for engaging the second D-ring 150. The other end of the second strap 154 is attached to an end of the longitudinal bar 44'. Located between the ends of the second strap 154 is a second buckle 158 that permits the length of the second strap 154 to be adjusted.

When the dividing system is in use, the shape of the ridge 138 is adjusted by adjusting the lengths of the first strap 144 and the second strap 154 using, respectively, the first buckle 148 and the second buckle 158. Further, if desired, the first snap hook 146 and the second snap hook 156 can be respectively disengaged from the first D-ring 140 and the second D-ring 150 to eliminate the ridge 138 dividing the chair 12' into the first chair 132A and second chair 132B.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternate embodiments to the extent permitted by the prior art.

What is claimed is:

1. A hanging chair for accommodating at least a first user and a second user comprising:

a chair member made of a flexible material and having a first chair portion with a first seat portion for supporting the lower extremities of the first user and a first back portion for supporting the back of the first user, and a second chair portion with a second seat portion for supporting the lower extremities of the second user and a second back portion for supporting the back of the second user;

said chair member having a bisecting line that lies between said first chair portion and said second chair portion;

said chair member having a dividing member located along said bisecting line; and a suspension structure for suspending said chair member from an overhead support;

said suspension structure, when said chair member is suspended from an overhead support, is separated from the ground;

said suspension structure comprising a frame, a first strap and a second strap;

wherein, when said chair member is suspended from an overhead support, said frame is oriented such that first and second locations on said frame are above the highest point of said first and second back portions, said first strap extending from a first point on said bisecting line to said first location on said frame, and said second strap extending from a second point on said bisecting line that is separated from said first point to said second location on said frame that is separated from said first location on said frame.

2. A hanging chair, as claimed in claim 1, wherein:

said dividing member is located between one of the following: (a) said first seat portion and second seat portion; (b) said first back portion and second back portions; and (c) said first and second seat portions and said first and second back portions.

3. A hanging chair, as claimed in claim 1, wherein:

said dividing member, when said chair member is suspended from an overhead support, having a cross-section with an inverted V-shape.

4. A hanging chair, as claimed in claim 1, wherein:

at least one of said first and second straps includes a connection/disconnection device.

5. A hanging chair, as claimed in claim 1, wherein:

said first and second straps each include a connection/disconnection device.

6. A hanging chair, as claimed in claim 1, wherein:

said first chair portion, said second chair portion, and said dividing member have a collective cross-section with a W-shape or double U-shape.

7. A hanging chair, as claimed in claim 1, wherein:

said suspension structure includes first and second attachment devices for engaging an overhead support at two different locations.

8. A hanging chair, as claimed in claim 1, further comprising:

a first foot rest and a second foot rest.

9. A hanging chair comprising:

a chair member having a seat portion for supporting the lower extremities of a user when the user is seated normally and the user's legs are parallel to another, and a back portion for supporting the back of a user;

said chair member having a bisecting line that divides both said seat portion and said back portion into substantially equal halves;

said bisecting line, when said chair member is suspended from an overhead support, defines a first plane that is perpendicular to the ground;

said seat portion, when said chair member is suspended from an overhead support, lies roughly in a second plane that is perpendicular to said first plane;

said back portion, when said chair member is suspended from an overhead support, lies roughly in a third plane that is perpendicular to said first plane;

an angle between said second and third planes along said bisecting line is less than 180 degrees;

a support member that, when said chair member is suspended from an overhead support, has at least two locations which lie substantially in said first plane defined by said bisecting line of said chair member;

first means for attaching said chair member to said support member;

said first means, when said chair member is suspended from an overhead support, is separated from the ground; and second means for attaching said support member to an overhead support;

said second means, when said chair member is suspended from an overhead support, is separated from the ground;

said support member, first means and second means, when said chair member is suspended from an overhead support, collectively bear substantially all of the weight of the user;

wherein said second means is substantially located in said first plane.

10. A hanging chair, as claimed in claim 9, wherein:

said chair member is dimensioned to accommodate more than one person.

11. A hanging chair, as claimed in claim 10, wherein:

said support member includes a longitudinal support member that lies substantially in said first plane.

12. A hanging chair, as claimed in claim 10, wherein:

said chair member includes a dividing member that is located along said bisecting line and divides said chair member into a first chair portion for accommodating a first person and a second chair portion for accommodating a second person.

13. A hanging chair, as claimed in claim 10, wherein:

said second means includes a first attachment means for making an attachment to the overhead member at a first location and a second attachment means for making an attachment to the overhead member at a second location.

14. A hanging chair, as claimed in claim 9, wherein:

said second means includes a swivel that permits said chair member to rotate about a vertical axis.

15. A hanging chair, as claimed in claim 11, wherein:

said first means includes a lateral support member that, when said chair member is suspended from an overhead support, extends substantially perpendicular to said first plane defined by said longitudinal line of said chair member;

said lateral support member is longer than said longitudinal support member.

16. A hanging chair, as claimed in claim 15, wherein:

said lateral support member has a length greater than about four feet.

17. A hanging chair, as claimed in claim 11, wherein:

said first means includes a first lateral support member and second lateral support member that, when said chair member is suspended from an overhead support, each extend substantially perpendicular to said first plane defined by said longitudinal line of said chair member;

one of said first lateral support member and said second lateral support member is longer than said longitudinal support member.

18. A hanging chair, as claimed in claim 9, wherein:

said support member is curved.

19. A hanging chair, as claimed in claim 9, wherein:

said support member forms a closed surface.

20. A hanging chair, as claimed in claim 9, wherein:

said support member has a circular shape.

21. A hanging chair, as claimed in claim 9, wherein:

said second means includes means for adjusting the angle of said chair member relative to the ground.

22. A hanging chair, as claimed in claim 9, wherein:

said second means includes a slip knot.

23. A hanging chair, as claimed in claim 9, wherein:

said second means includes a linkage extending between ends of said support member;

wherein the length of said linkage is adjustable.

24. A hanging chair comprising:

a chair member having an edge, a seat portion for supporting the lower extremities of a user when the user is seated normally and the user's legs are parallel to one another, and a back portion for supporting the back of a user;

said chair member having a bisecting line that divides both said seat portion and said back portion into substantially equal halves;

wherein said bisecting line, when said chair member is suspended from an overhead support, defines a first plane that is perpendicular to the ground;

wherein said seat portion, when said chair member is suspended from an overhead support, lies roughly in a second plane that is perpendicular to said first plane;

wherein said back portion, when said chair member is suspended from an overhead support, lies roughly in a third plane that is perpendicular to said first plane;

wherein an angle between said second and third planes along said bisecting line is less than 180 degrees;

a support member that, when the chair is suspended from an overhead support, has at least two locations which lie substantially in said first plane defined by said bisecting line of said chair member;

first means for attaching said edge of said chair member to said support member;

wherein said first means, when said chair member is suspended from an overhead support, is separated from the ground; and second means for attaching said support member to an overhead support;

wherein said second means; when said chair member is suspended from an overhead support, is separated from the ground;

wherein said support member, first means and second means, when said chair member is suspended from an overhead support, collectively bear substantially all of the weight of the user;

wherein said second means includes means for adjusting the angle of said chair member relative to the ground;

wherein said second means includes connector means that can selectively be fixed in place at a number of locations on said support member and swivel means that is operatively connected to said connector means.

25. A hanging chair, as claimed in claim 9, wherein:

said first means includes means for adjusting the distance between said seat portion of said chair member and said support member.

26. A hanging chair, as claimed in claim 9, where in:

said first means includes a lateral member that extends substantially perpendicular to said first plane defined by said bisecting line of said chair member.

27. A hanging chair, as claimed in claim 26, wherein:

said lateral member is located between said support member and said chair member.

28. A hanging chair, as claimed in claim 9, wherein:

said first means includes fruit and second lateral members both of which are located substantially perpendicular to said first plane defined by said bisecting line of said chair member.

29. A hanging chair, as claimed in claim 28, wherein:

said first and second lateral members are both located between said support member and said chair member.

30. A hanging chair, as claimed in claim 28, wherein:

said first and second lateral members have different lengths.

31. A hanging chair, as claimed in claim 28, wherein:

said support member is longer than both said first and second lateral members.

32. A hanging chair, as claimed in claim 9, wherein:

said support member is substantially symmetrical about said longitudinal line.

33. A hanging chair, as claimed in claim 9, further comprising:

a foot rest that is operatively attached to said longitudinal support member.

34. A hanging chair, as claimed in claim 1, wherein:

said first point is located substantially adjacent to an edge of said chair m ember that defines the uppermost extent of said first and second back portions when said chair member is suspended from an overhead support.

35. A hanging chair, as claimed in claim 1, wherein:

said second point is located substantially adjacent to an edge of said chair member that defines the lowermost extent of said first and second seat portions when said chair member is suspended from an overhead support.

36. A hanging chair, as claimed in claim 1, wherein:

said first point is located substantially adjacent to an edge of said chair member that defines the uppermost extent of said first and second back portions when said chair member is suspended from an overhead support; and said second point is located substantially adjacent to an edge of said chair member that defines the lowermost extent of said first and second seat portions when said chair member is suspended from an overhead support.

* * * * *

UNITED STATES PATENT AND TRADEMARK OFFICE

CERTIFICATE OF CORRECTION

PATENT NO. : 6,364,412 B1
DATED : April 2, 2002
INVENTOR(S) : David H. Crawford

It is certified that error appears in the above-identified patent and that said Letters Patent is hereby corrected as shown below:

Title page,
Item [56], under References Cited - U.S. PATENT DOCUMENTS, delete "784,484" and insert -- 794,484 --; and delete Middlendorf" and insert -- Middendorf --;
Item [57], under ABSTRACT, delete "inmost" and insert -- in most --;

Column 5,
Line 12, delete "aback" and insert -- a back --;

Column 8,
Line 45, delete "1121B' and insert -- 112B --;
Line 46, delete "111B" and insert -- 110B --;
Line 47, delete "1163B" and insert -- 116B --;

Column 12,
Line 50, delete "means;" and insert -- means, --;

Column 13,
Line 9, delete "fruit" and insert -- first --; and

Column 14,
Line 7, delete "m ember" and insert -- member --.

Signed and Sealed this

Eleventh Day of June, 2002

*Attest:*

*Attesting Officer*

JAMES E. ROGAN
*Director of the United States Patent and Trademark Office*